US007634857B2

(12) United States Patent
Ueki et al.

(10) Patent No.: US 7,634,857 B2
(45) Date of Patent: Dec. 22, 2009

(54) STEEL PLATE SPROCKET AND METHOD OF PRODUCING SAME

(75) Inventors: Takashi Ueki, Osaka (JP); Katsuhiro Yamamoto, Saitama (JP)

(73) Assignees: Tsubakimoto Chain Co., Osaka (JP); Yamamoto Seisakusho Co., Ltd., Higashimatsuyama (JP)

( * ) Notice: Subject to any disclaimer, the term of this patent is extended or adjusted under 35 U.S.C. 154(b) by 103 days.

(21) Appl. No.: 11/653,756

(22) Filed: Jan. 16, 2007

(65) Prior Publication Data

US 2008/0014036 A1 Jan. 17, 2008

(30) Foreign Application Priority Data

Feb. 20, 2006 (JP) ..... 2006-042914

(51) Int. Cl.
*B21D 53/28* (2006.01)
*B21J 13/00* (2006.01)

(52) U.S. Cl. ..... 29/893.34; 29/893.33; 72/352; 72/354.6; 72/355.2

(58) Field of Classification Search ..... 29/893.33–37, 29/893, 893.3; 72/327, 329, 336, 335, 352, 72/353.2, 354.6, 355.2, 355.6
See application file for complete search history.

(56) References Cited

U.S. PATENT DOCUMENTS

| | | | | | |
|---|---|---|---|---|---|
| 2,224,993 | A * | 12/1940 | Swift et al. | 29/13 |
| 3,796,085 | A * | 3/1974 | Fisher et al. | 72/348 |
| 4,248,075 | A * | 2/1981 | Whitley | 72/335 |
| 4,569,263 | A * | 2/1986 | Kravets | 83/19 |
| 4,876,876 | A * | 10/1989 | Ishida et al. | 72/348 |
| 6,209,381 | B1 * | 4/2001 | Yaguchi et al. | 72/416 |
| 6,370,931 | B2 * | 4/2002 | Bennett | 72/336 |
| 6,729,172 | B2 * | 5/2004 | Aizaki | 72/329 |
| 7,526,862 | B2 * | 5/2009 | Leveque et al. | 29/889.7 |
| 2006/0042341 | A1 * | 3/2006 | Nishibu | 72/335 |

FOREIGN PATENT DOCUMENTS

| | | | |
|---|---|---|---|
| JP | 58074231 | A * | 5/1983 |
| JP | 2002-001449 | | 1/2002 |

* cited by examiner

*Primary Examiner*—Jermie E Cozart
*Assistant Examiner*—Ryan J Walters
(74) *Attorney, Agent, or Firm*—Howson & Howson LLP

(57) ABSTRACT

A sprocket is formed by fine-blanking a steel plate using a die having a cutting edge shaped to produce rounded edges on the back sides of the sprocket tooth heads, and protrusions on the front sides. Thereafter the edges of the front sides of the sprocket tooth heads are formed in a press so that the protrusions are removed, and the edges of the front sides of the sprocket tooth heads have a rounded cross-sectional shape substantially the same as that of the edges of the front sides.

4 Claims, 13 Drawing Sheets

Fig. 4

| | a | b | Fracture | Burr | Evaluation |
|---|---|---|---|---|---|
| 1 | 1.332 | 4.919 | Present | Small | |
| 2 | 1.988 | 5.968 | Absent | Large | |
| 3 | 1.552 | 5.315 | Absent | Middle | |
| 4 | 1.716 | 5.653 | Absent | Middle | |
| 5 | 2.017 | 5.975 | Present | Small | |
| 6 | 1.849 | 5.723 | Absent | Middle | |
| 7 | 1.922 | 5.821 | Absent | Middle | ◎ |

STEEL PLATE SPROCKET AND METHOD OF PRODUCING SAME

CROSS-REFERENCE TO RELATED APPLICATION

This application claims priority on the basis of Japanese patent application 2006-042914, filed Feb. 20, 2006. The disclosure of Japanese application 2006-042914 is hereby incorporated by reference.

FIELD OF THE INVENTION

This invention relates generally to the formation of machine elements, and more particularly to the formation of a steel plate sprocket.

BACKGROUND OF THE INVENTION

Most internal combustion engines include a timing transmission in which an endless chain delivers power from a driving sprocket to a driven sprocket. The sprockets have been typically produced by sinter molding of a powder alloy or by skiving bulk steel. However, more recently, because of diverse user requirements, such as improvement of quality and production, cost reduction, short delivery time, and the like, sprockets have been produced by fine blanking of steel plate. Such a process is described in Japanese Laid-Open Patent Publication No. 2002-1449.

Fine blanking is a precision process in which a material to be blanked or punched is constrained so that the material is sheared while compression force is applied to the material from all directions. In fine blanking, a workpiece is held under a high pressure against a die by means of a V-ring, and a portion is punched out of the workpiece by means of a punch, while a counter force is applied by a reverse punch back-up. The fine blanking process is capable of producing parts which are flatter, more uniform, and dimensionally more accurate, and which have a cleaner shear face, than parts produced by conventional stamping.

In the fine blanking process, as illustrated by FIGS. 7(*a*), 7(*b*) and 7(*c*,) a phenomenon known as "penetration," produces a curved portion 260 and a protruding portion 250, as seen in FIG. 7(*c*), which is a detailed view of a peripheral part of the sprocket shown in FIGS. 7(*a*) and 7(*b*). Thus, after fine blanking, another fabrication step, such as turning, milling, or the like, is required to shave or remove the protruding portion. Then, a further finishing step is required, at the location where the protruding portion was removed, in order to provide the front and back sides of the tooth head with the same round cross-section corresponding to the shape of the curved portion 260. Even when the tooth head is finished so that has a symmetric curvature, the process of turning, milling, or the like, can leave a burr at a tooth bottom or on a tooth side, which can cause damage or excessive wear to a chain that engages the sprocket.

BRIEF SUMMARY OF THE INVENTION

This invention addresses the above-mentioned problems by a two-step process in which a punching step, carried out using the fine blanking technique, is followed by a pressing step in which the edge of the workpiece, at which the protruding portion is formed in the punching step, is formed in such a way that it has substantially the same rounded cross section as the opposite edge formed in the punching step.

More specifically, in accordance with the invention, a machine element is formed by punching a blank from a steel plate by fine blanking, thereby forming a machine element having front and back sides and a connecting face, with a rounded transition between the back side and the connecting face, and thereafter, by pressing the machine element formed in the punching step, forming a rounded transition between the front side and the connecting face. The rounded transition between the front side and the connecting face can be formed so that it has substantially the same shape as the rounded transition between the back side and the connecting face.

The invention is particularly useful for making a sprocket having sprocket tooth heads with rounded front and back sides. In such a case the method is carried out by punching a sprocket blank from a steel plate by fine blanking, thereby forming sprocket tooth heads with rounded back sides, and thereafter, by pressing the sprocket tooth heads, forming rounded front sides on the sprocket tooth heads, the rounded front sides having substantially the same shape as the rounded back sides. The step of punching a sprocket blank from a steel plate by fine blanking is preferably carried out by the use of a die having a cutting edge in the form of a fillet or chamfer.

A clean, rounded, cross-sectional shape at the sheared surface can be formed on the front and back sides of the tooth heads of a steel plate sprocket by a pressing step, and without more difficult fabrication steps such as turning, milling and the like.

By the process according to the invention, a sprocket can be produced, in which, if misalignment occurs between the sprocket and a chain engaged with the sprocket, the chain returns reliably to its normal alignment. The sprocket has a high added value, and can meet diverse user requirements, including improvement of quality, production cost reduction, short delivery time, and the like.

In a conventional punching operation, the cut end of the punched product has a fracture surface on half or more of the area of its cut end. Moreover, the required precision cannot be obtained unless finish machining, such as turning, milling or the like, is performed. On the other hand, in the fine blanking and pressing process according to the invention, the entire surface of a cut end of a product, for example a sprocket, becomes a fine sheared surface, and finish machining is not required.

BRIEF DESCRIPTION OF THE DRAWINGS

FIG. 4 is a table showing features of the back sides of sprocket tooth heads formed by the various dies in FIG. 3;

FIG. 5(*b*) is an enlarged view of a part outlined by the broken line circle Vb in FIG. 5(*a*);

FIG. 6(*b*) is an enlarged view of a part outlined by the broken line circle VIb in FIG. 6(*a*);

FIG. 7(*b*) is a cross-sectional view of the conventional sprocket taken on plane VIIb-VIIb of FIG. 7(*a*); and FIG. 7(*c*) is an enlarged view of a part outlined by the broken line circle VIIc in FIG. 7(*b*).

DETAILED DESCRIPTION OF THE PREFERRED EMBODIMENTS

Figure 1A:
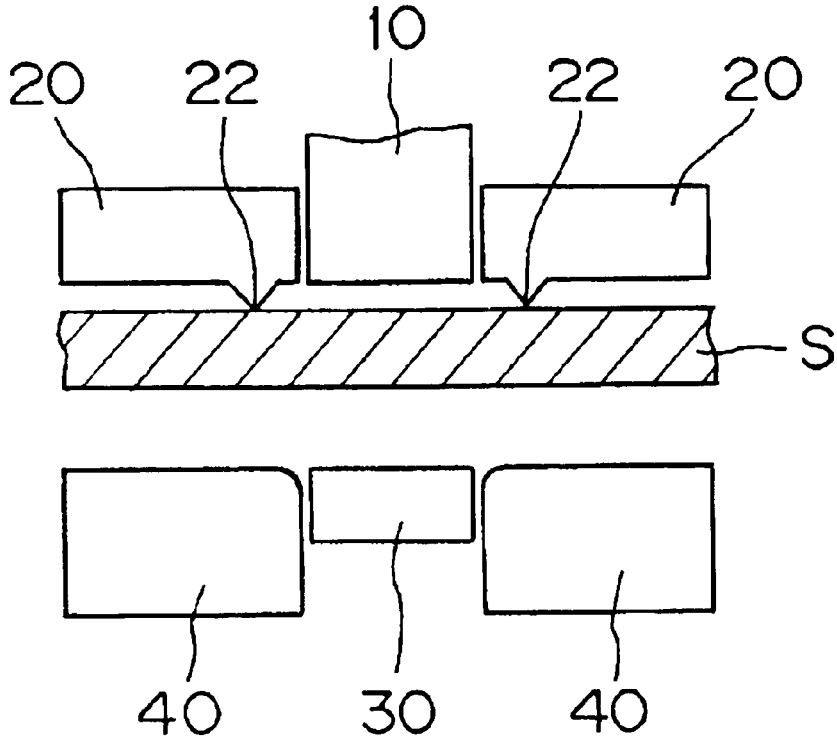
FIGS. 1(*a*)-1(*f*) are schematic sectional views of a punch, illustrating the punching step, in the process of producing a steel plate sprocket in accordance with the invention.
Figure 1B:
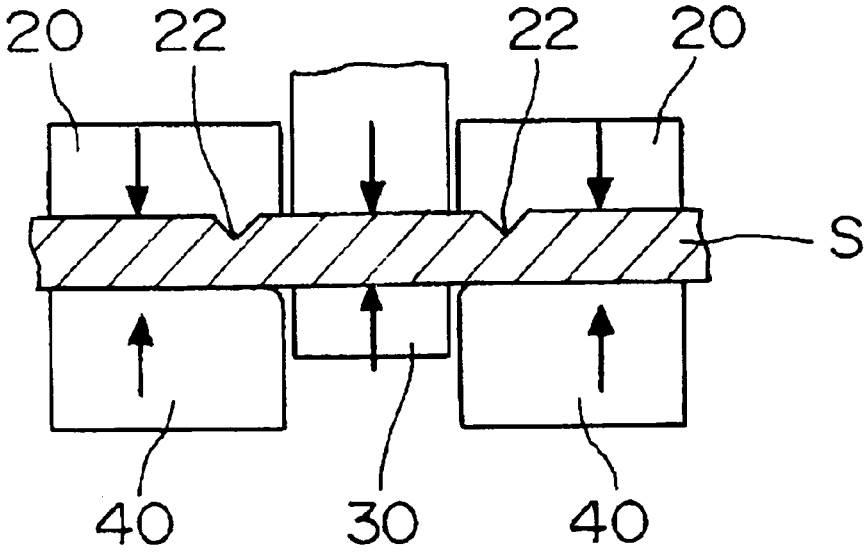
Figure 1C:
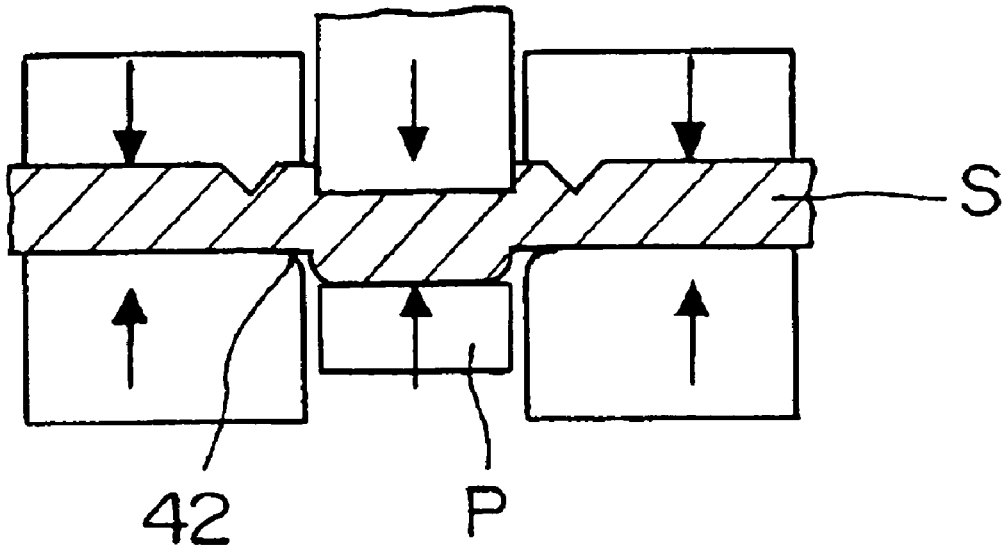
Figure 1D:
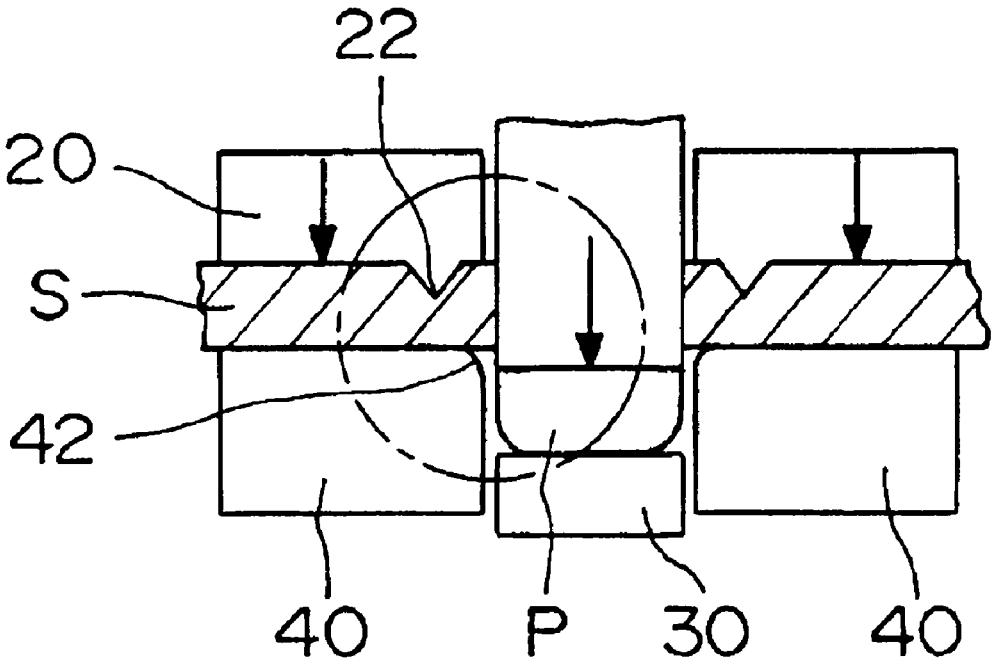
Figure 1E:
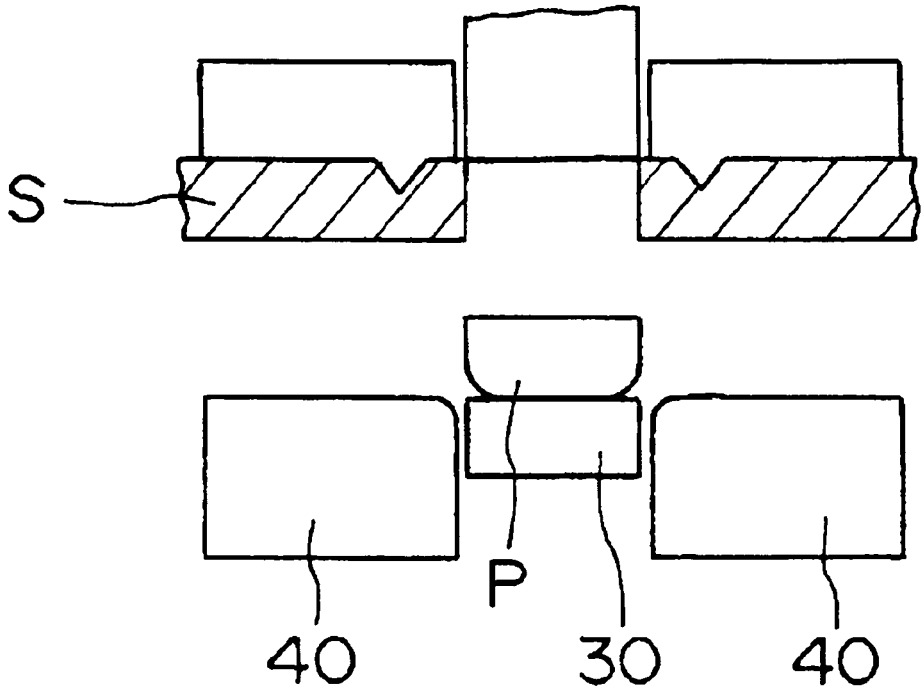
Figure 1F:
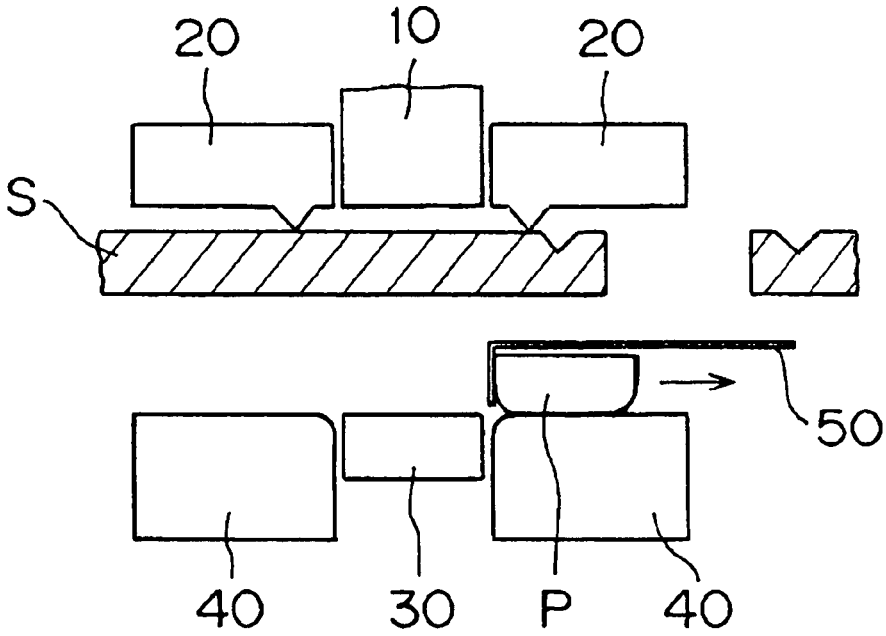

FIGS. 1(*a*) to 1(*f*) illustrate the progress of the fine blanking operation, which is the first step of the process according to the invention. The figures show the fine blanking of a steel plate sprocket.

As shown in FIG. 1(*a*), a steel plate S is passed through a metal mold for fine blanking. The metal mold comprises a punch 10 and a cooperating die 40, a back-up plate 20, opposed to the die 40 and having a knife edge-shaped V-ring 22, and a reverse punch backup 30 opposed to the punch 10.

As shown in FIG. 1(*b*), a lower mold part, comprising the reverse punch backup 30 and the die 40, is raised, and a pressing force is applied to the plate S. At this time, pressure is applied to the reverse punch backup 30 and the plate backup 20 by means of a hydraulic press (not shown). The knife edge-shaped V ring 22, which is provided on the plate backup 20 along the profile of the product, is pressed into the steel plate S. The steel plate S, which tends to expand in a direction perpendicular to the direction of movement of the punch (i.e., horizontally in FIG. 1(*b*)), is held by the V-ring 22 so that the compression force applied to the steel plate S is enhanced.

As shown in FIG. 1(*c*), the lower part of the mold is raised further, so that blanking of the product P (a sprocket) is started. At this time, a sheared surface is formed on the upper part of the end surface of the steel plate S by the outer circumferential edge of the punch 10. This sheared surface is disposed substantially at a right angle to the upper face of the plate S. The shape of the lower part of the end surface of the steel plate S depends on the shape of the cutting edge 42 of the die 40.

Figure 2:
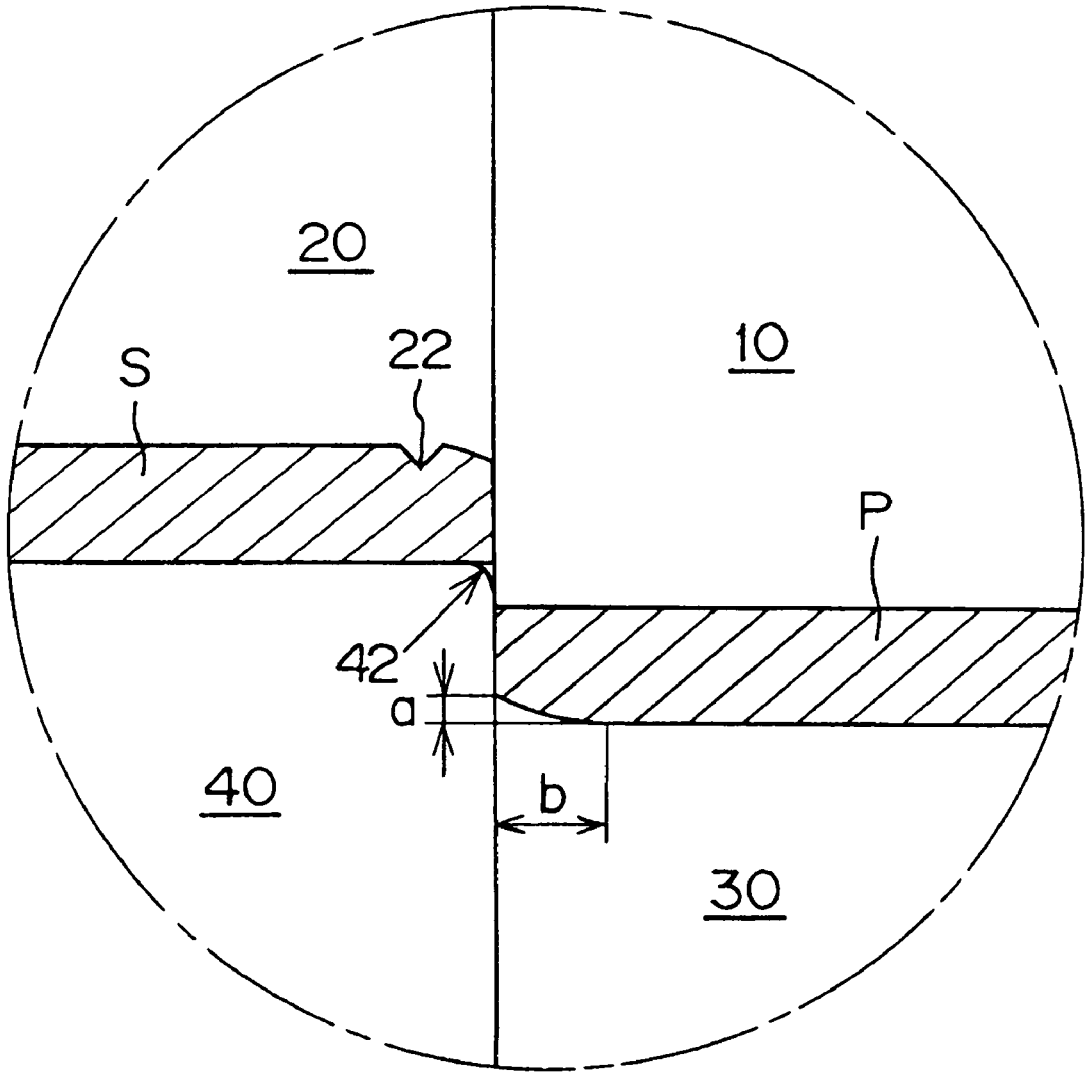
FIG. 2 is an enlarged view of a part outlined by a broken line circle in FIG. 1(*d*)

FIG. 2, which is an enlarged view of the area surrounded by a circle in FIG. 1(*d*), shows the shape of a tooth head of a sprocket P obtained by blanking. The operation of the punch 10 forms the tooth head so that the upper part of the sheared surface of the tooth head is disposed substantially at a right angle to the upper face of the sprocket. On the other hand, the cross-section of the back side of the tooth head has a rounded cross-section. We have found that the height a and width b of the round shape in cross-section formed on the back side of the sprocket tooth head can be adjusted by selection of the shape of the cutting edge 42 of the die 40.

Figure 3:
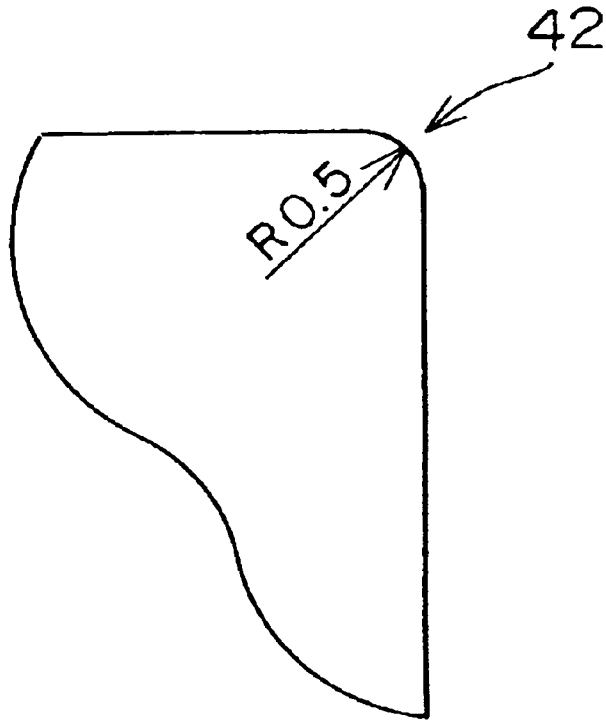
FIGS. 3(1)-3(7) are schematic views showing the shapes of the cutting edges of various dies used to carry out the punching step.
Figure 3:
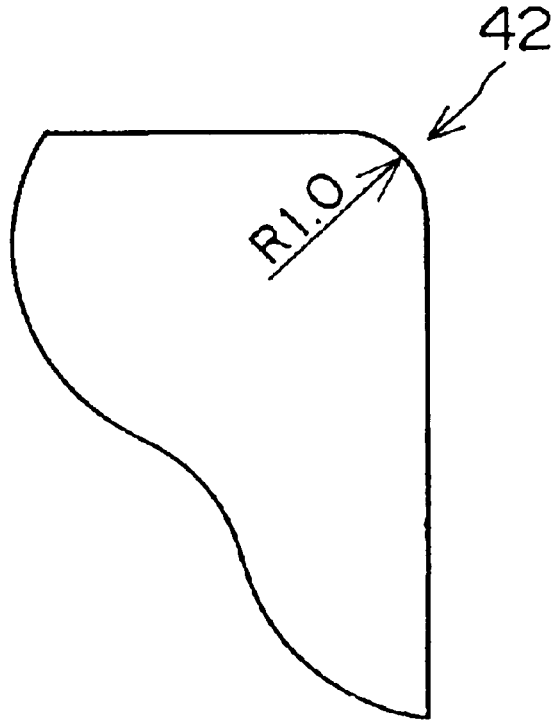
Figure 3:
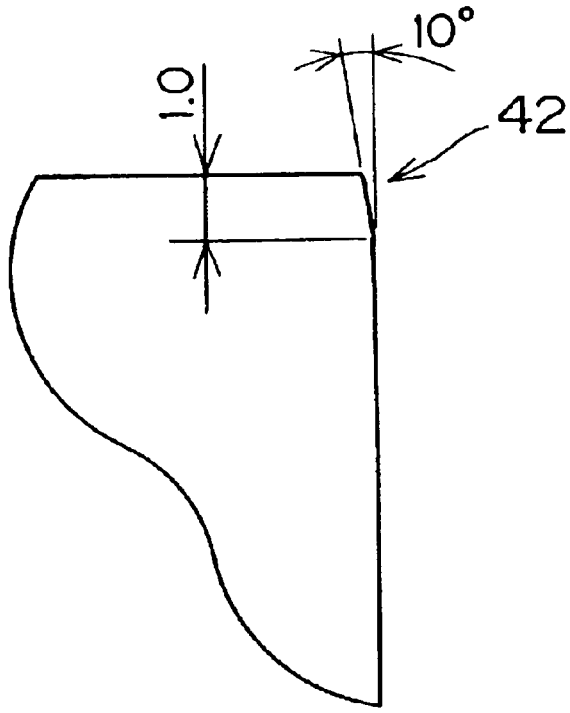
Figure 3:
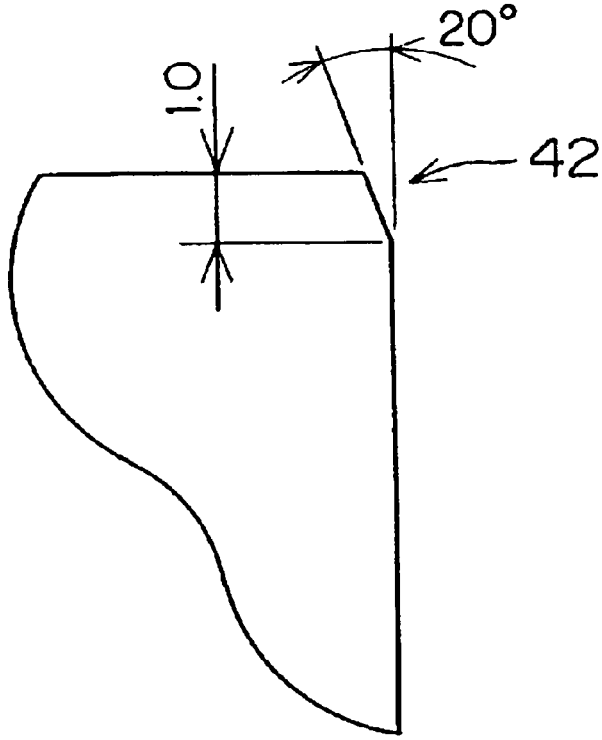
Figure 3:
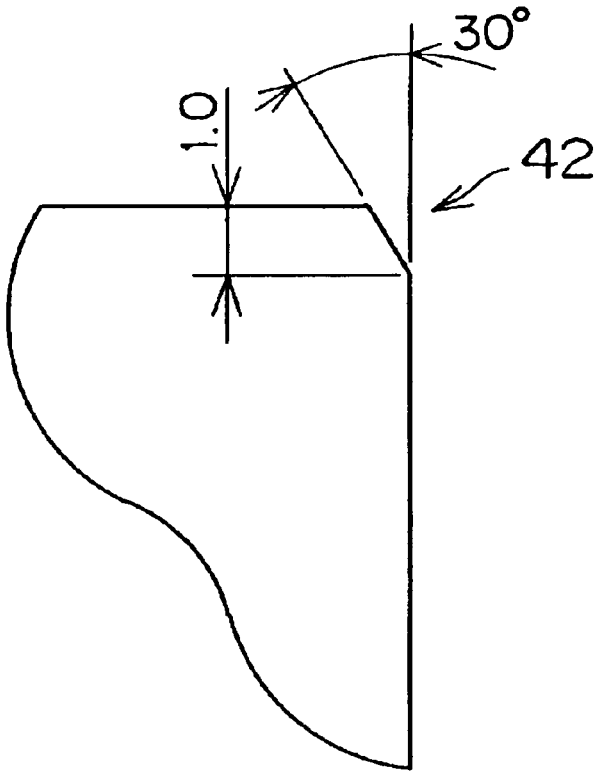
Figure 3:
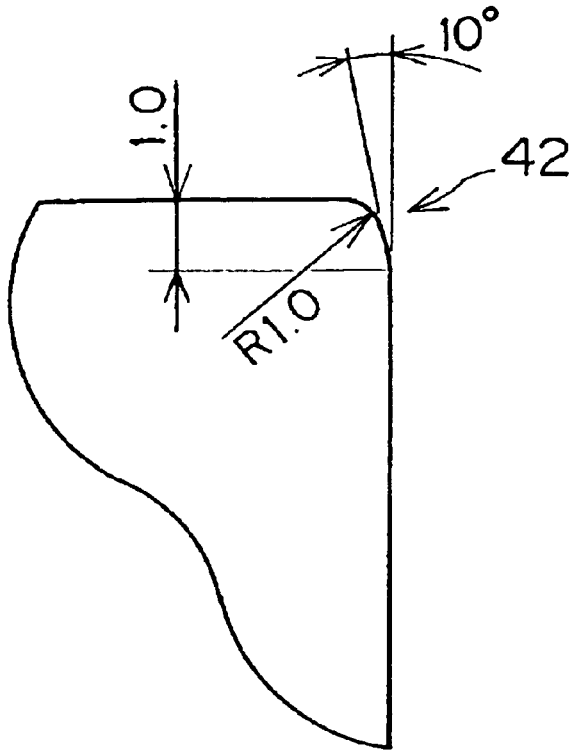
Figure 3:
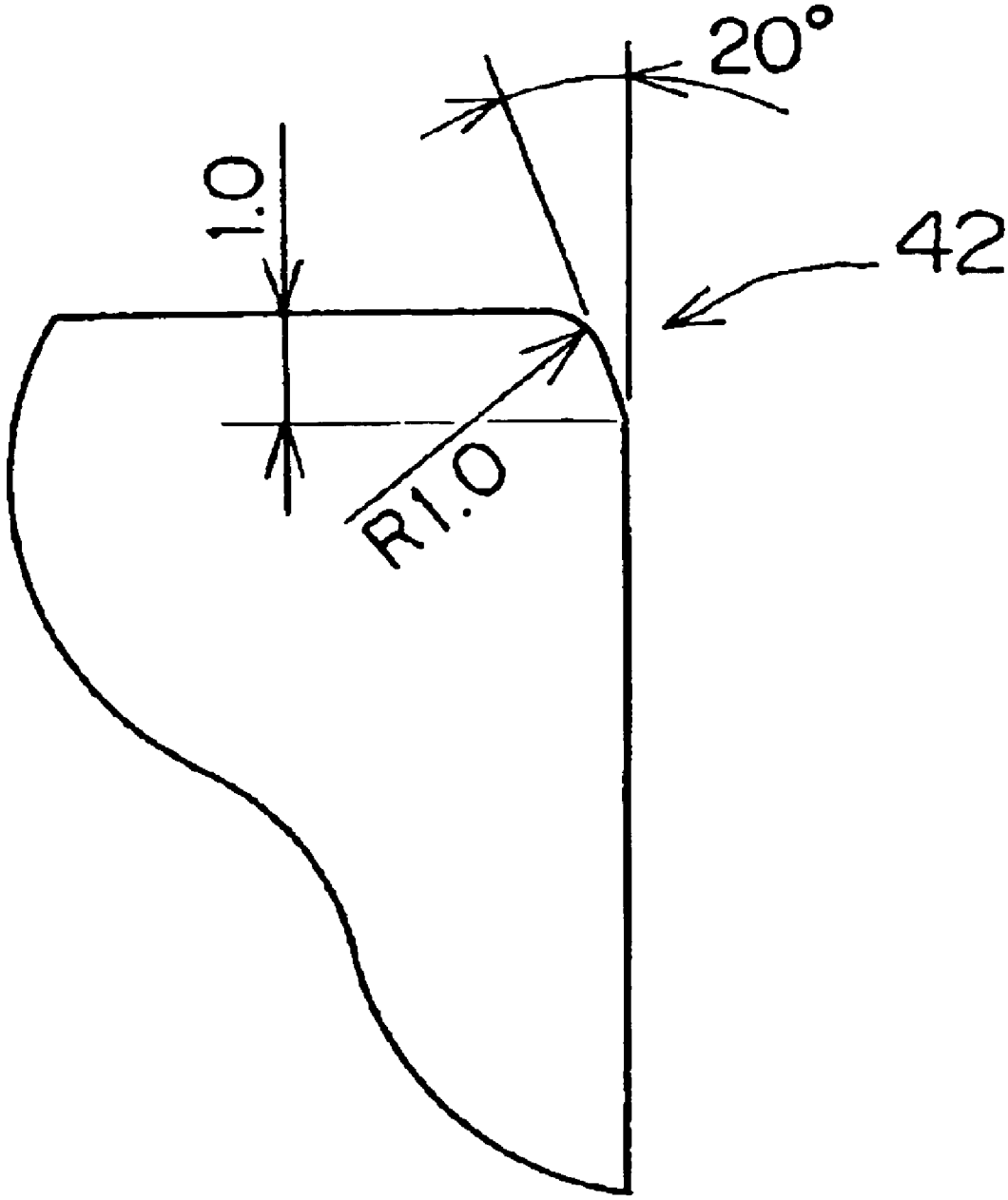

We prepared a plurality of dies having cutting edges 42 of various shapes, as shown in FIGS. 3(1)-3(7). These shapes include rounded shapes (fillets) as in FIGS. 3(1) and 3(2), beveled shapes (chamfers) as in FIGS. 3(3) and 3(5) and combinations of rounded and beveled shapes, as in FIGS. 3(6) and 3(7). The heights a and widths b of the round shapes of the cross-sections formed on the back sides of the sprocket tooth heads were measured and the results of our experiments, using the seven different cutting edge shapes of FIGS. 3(1)-3(7), are shown in FIG. 4, in which the numbers in the left-hand column correspond to the numbers in parentheses in the figure numbers of FIGS. 3(1)-3(7).

The specification of the rounded cross-section formed on the surface and back sides of the sprocket tooth head was 2.0 mm in height a and 5.85 mm in width b. The seventh cutting edge (the cutting edge shown in FIG. 3(7)) produced a rounded cross-section having a height a and a width b very near the specified values. It did not generate a fracture in the cross section, and did not generate a large burr. The seventh cutting edge was judged to be the one most suitable. Data on the shapes of the rounded cross sections produced by the various cutting edges 42 of the dies 40 were stored in a computer, and were used for determining the shapes of cutting edges used in the production of other sprockets. The data can be used to select the appropriate dies to produce a desired rounded tooth head cross-section, and, as more sprockets are produced, more data can be stored, and more precise sprockets can be produced.

As shown in FIG. 1(*d*), blanking is completed as the lower parts of the mold reach the upper limit of their stroke. Then, as shown in FIG. 1(*e*) the lower parts of the mold are lowered, and, at the same time, the reverse punch backup 30 is raised. The product P (a sprocket) can then be released from the mold.

As shown in FIG. 1(*f*), the steel plate S is lowered to release it from the V-ring, and fed horizontally to a position in which another blanking operation can take place as depicted in FIGS. 1(*a*)-1(*f*). At the same time, the product P (a sprocket) is moved outside the mold by a takeoff member 50, and is transferred to a press in which a second step of the process is carried out.

Figure 5A:
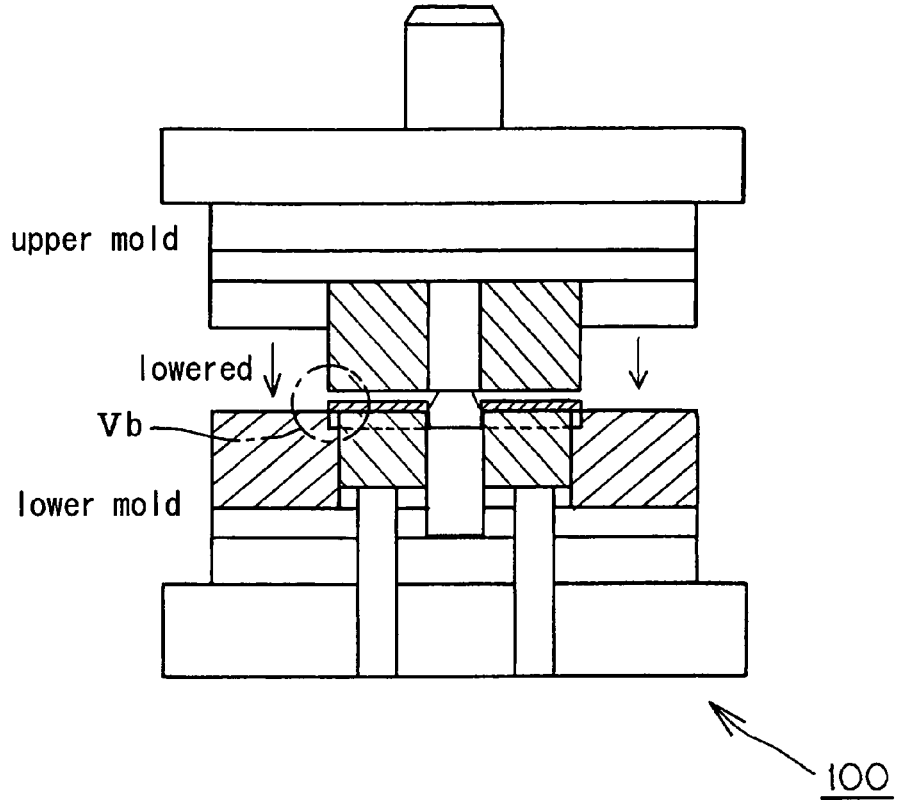
FIG. 5(*a*) is a schematic sectional view illustrating the start of the pressing step.
Figure 5B:
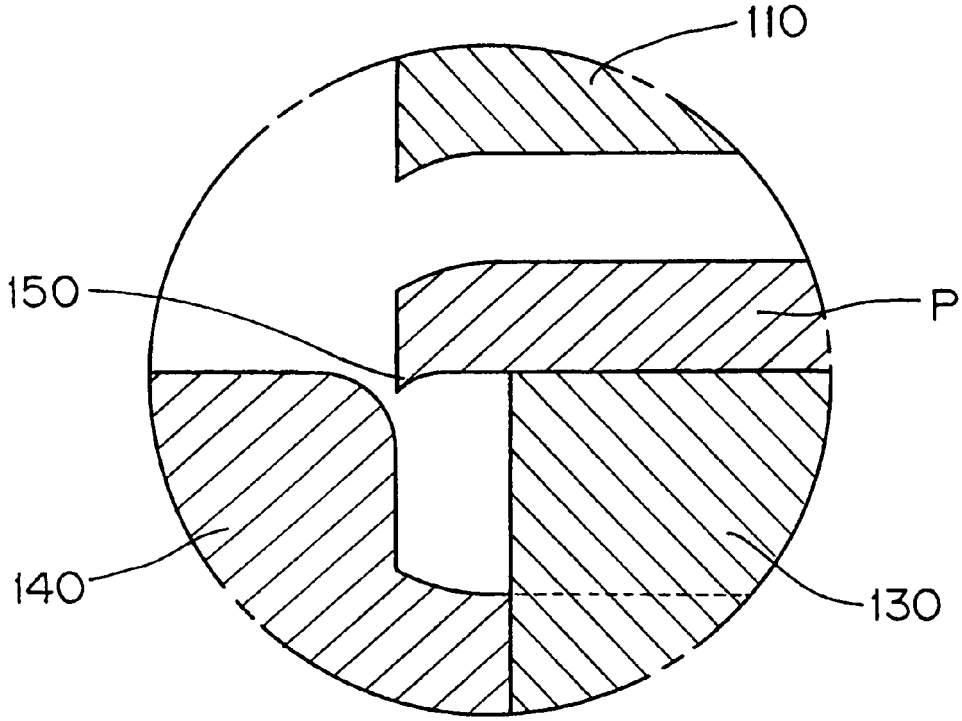

In the second step of the process, the product P, in which only one side has a rounded cross-sectional shape is moved into press 100, as shown in FIG. 5(*a*). As seen in FIG. 5(*b*), the press has a punch 110, a reverse punch backup 130, and a die 140. Also, as seen in FIG. 5(*b*), the product P is inverted so that its back side, i.e., the side having the rounded edge, faces upward. Its lower edge, i.e., the edge of the front side, has a protrusion 150.

Figure 6A:
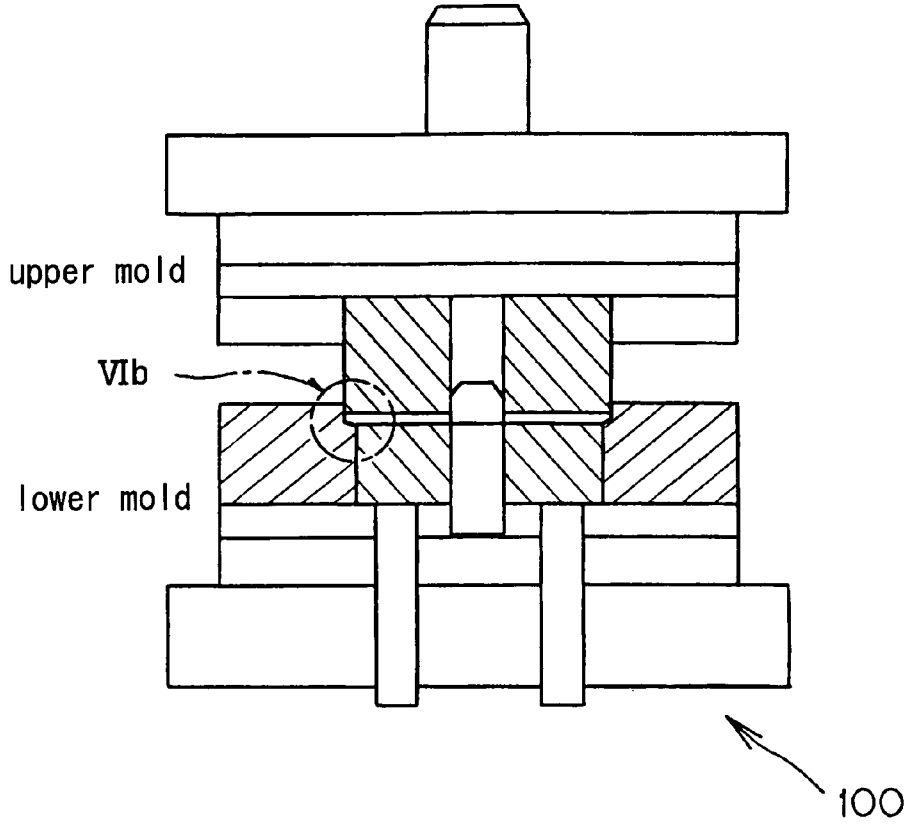
FIG. 6(*a*) is a schematic sectional view illustrating the completion of the pressing step.
Figure 6B:
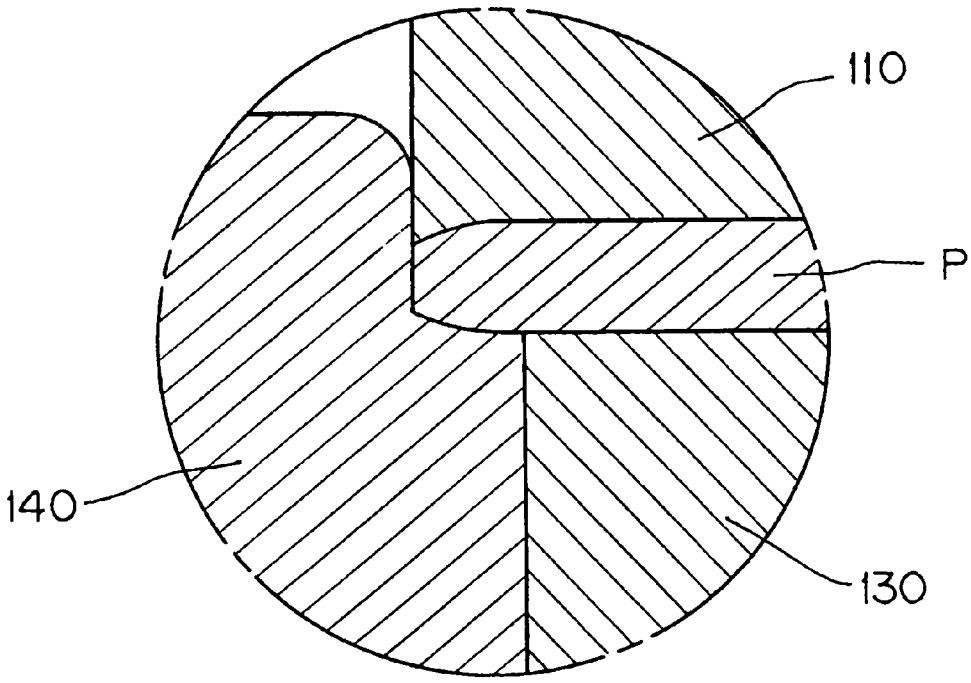
Figure 7A:
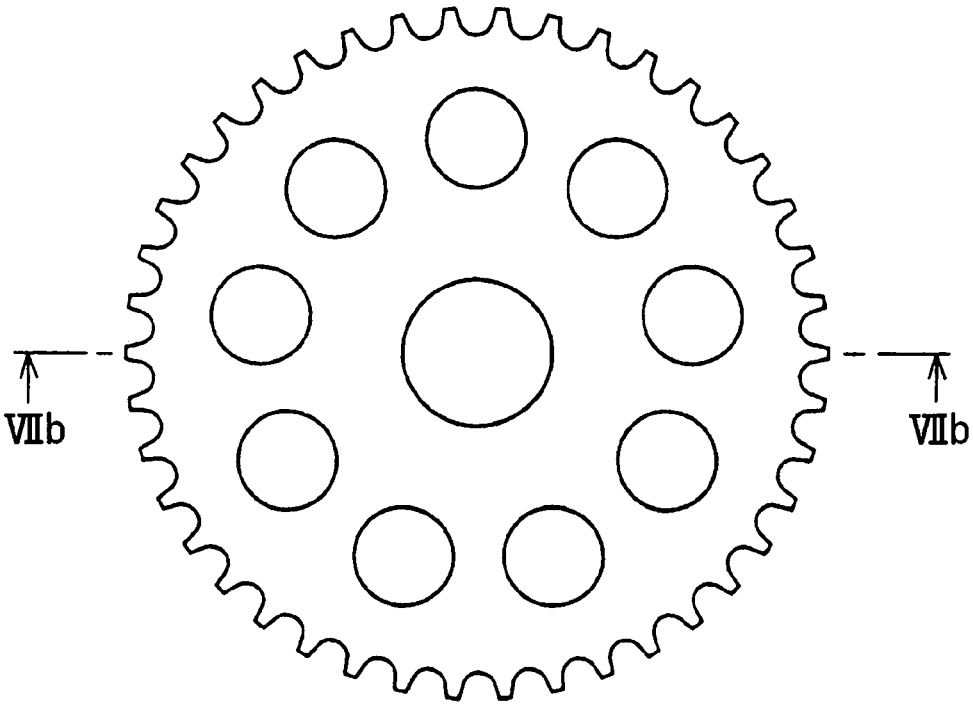
Fig. 7(a) Prior Art
FIGS. 7(*a*), 7(*b*) and 7(*c*) are views showing a conventional steel plate sprocket, and particularly FIG. 7(*a*) is a plan view of a conventional steel plate sprocket.
Figure 7B:
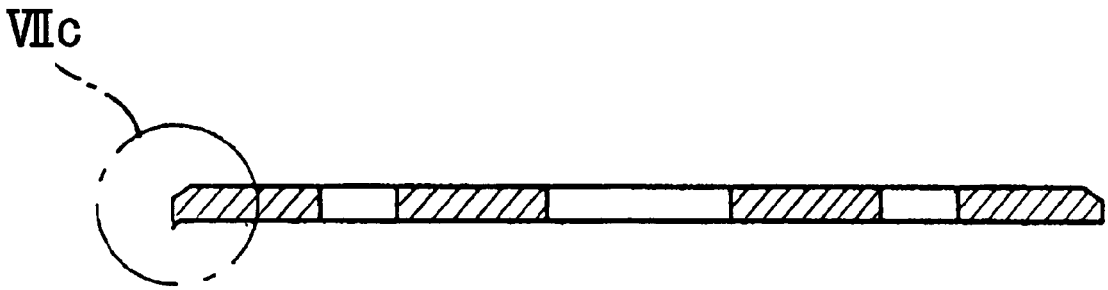
Fig. 7(b) Prior Art
Figure 7C:
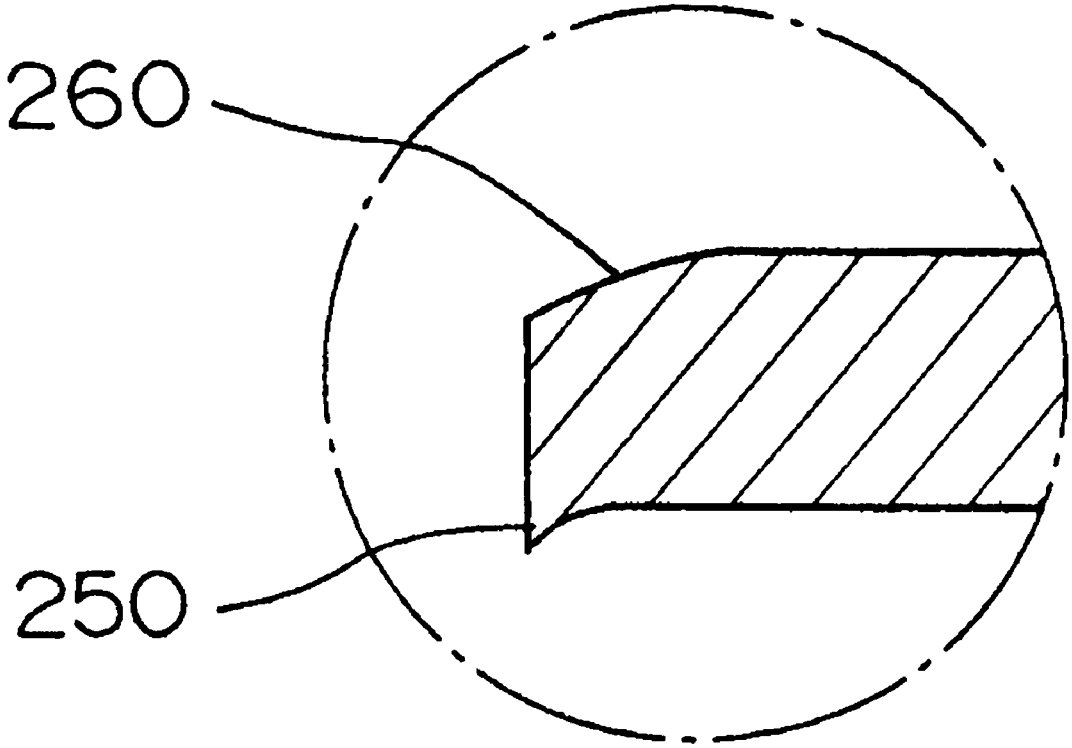
Fig. 7(c) Prior Art

As shown in FIGS. 6(*a*) and 6(*b*), the product P is compressed by the punch 110 and the die 140 to crush the protrusion 150, which was formed in the blanking step. Thus both the top and the bottom parts of the edge of the product are formed so that they have similar, preferably substantially identical, rounded shapes in cross section. That is, the transitions between the connecting face at the edge of the product and the front and back faces are rounded and substantially identical. The fine blanking die 40 can be selected based on the shape of the finishing die 140, or the finishing die can be selected based on the shape of the fine blanking die, so that the rounded cross-sectional shape of the edge of the back side of the sprocket, as formed in the fine-blanking step, corresponds to the rounded-cross-sectional shape of the edge of the front side of the sprocket, as formed by the blanking die.

Although the invention has particular application to the production of a metal plate sprocket, and has been described with reference to a sprocket, the production method according to the invention can be applied to various other products produced from metal plate. The process can be used to produce a tensioner lever, for example.

We claim:

1. A method for forming a sprocket having sprocket tooth heads with rounded front and back sides, comprising the steps of:

punching a sprocket blank from a steel plate by fine blanking, thereby forming sprocket tooth heads with rounded back sides and protrusions on their front sides; and thereafter, pressing the sprocket tooth heads between a punch and a die having opposed, rounded, sprocket tooth-engaging surfaces movable relatively toward each other in a direction of relative movement, said sprocket tooth-engaging surfaces being symmetrical with respect to a plane midway between them to which said direction of relative movement is perpendicular, thereby crushing said protrusions and forming rounded front sides on the sprocket tooth heads, and, while crushing said protrusions, causing said rounded front sides and said rounded back sides to assume substantially the same shape whereby said rounded front and back sides become symmetrical with respect to a plane midway between said front and back sides;

in which the sprocket tooth heads are pressed between said punch and said die while holding the sprocket tooth heads between said punch and a reverse punch back-up movable with said punch and relative to said die.

2. The method according to claim 1, in which the step of punching a sprocket blank from a steel plate by fine blanking is carried out by the use of a punching die having a cutting edge in the form of a fillet or chamfer.

3. A method of forming a machine element having front and back sides and a connecting face extending from the front side to the back side, with a rounded transition between each said side and the connecting face, the method comprising the steps of:

punching a blank from a steel plate by fine blanking, thereby forming a machine element having front and back sides and a connecting face, with a rounded transition between the back side and the connecting face and a protrusion at a transition between the front side and the connecting face; and thereafter, pressing the machine element formed in the punching step between a punch and a die having opposed, rounded, machine element-engaging surfaces movable relatively toward each other in a direction of relative movement, said machine element-engaging surfaces being symmetrical with respect to a plane midway between them to which said direction of relative movement is perpendicular, thereby crushing said protrusion and forming a rounded transition between the front side and the connecting face, and, while crushing said protrusion, causing said rounded transition between the front side and the connecting face and said rounded transition between the back side and the connecting face to become symmetrical with respect to a plane midway between said rounded transitions;

in which, in the step of crushing said protrusion and causing said rounded transitions to become symmetrical, the machine element is pressed between said punch and said die while holding the machine element between said punch and a reverse punch back-up movable with said punch and relative to said die.

4. A method of forming a machine element having front and back sides and a connecting face extending from the front side to the back side, with a rounded transition between each said side and the connecting face, the method comprising the steps of:

punching a blank from a steel plate by fine blanking, thereby forming a machine element having front and back sides and a connecting face, with a rounded transition between the back side and the connecting face; and thereafter, pressing the machine element formed in the punching step between a punch and a die having opposed, rounded, machine element-engaging surfaces movable relatively toward each other in a direction of relative movement, said machine element-engaging surfaces being symmetrical with respect to a plane midway between them to which said direction of relative movement is perpendicular, thereby forming a rounded transition between the front side and the connecting face, and, while pressing the machine element, causing said rounded transition between the front side and the connecting face and said rounded transition between the back side and the connecting face to become symmetrical with respect to a plane midway between said rounded transitions;

in which, in the step of pressing the machine element, the machine element is held between said punch and a reverse punch back-up movable with said punch and relative to said die; and in which said pressing step is the only step carried out following the punching step that affects a change in the shape of the transition between the front side and the connecting face.

* * * * *